US007677217B2

(12) United States Patent
Kumar et al.

(10) Patent No.: US 7,677,217 B2
(45) Date of Patent: Mar. 16, 2010

(54) POWER ASSEMBLY FOR INTERNAL COMBUSTION ENGINE WITH IN-CYLINDER DEPOSIT SCRAPER

(75) Inventors: Yogesh Kumar, Bangalore (IN); Richard J. McGowan, Slippery Rock, PA (US); Bryan T. Jett, Erie, PA (US); Neil X. Blythe, North East, PA (US); Kevin P. Bailey, Stoneboro, PA (US)

(73) Assignee: General Electric Company, Schenectady, NY (US)

( * ) Notice: Subject to any disclaimer, the term of this patent is extended or adjusted under 35 U.S.C. 154(b) by 111 days.

(21) Appl. No.: 11/869,775

(22) Filed: Oct. 10, 2007

(65) Prior Publication Data

US 2009/0095248 A1 Apr. 16, 2009

(51) Int. Cl.
*F02F 1/00* (2006.01)

(52) U.S. Cl. ..... 123/193.2; 123/193.3; 123/193.4

(58) Field of Classification Search ..... 123/193.2, 123/193.3, 193.4
See application file for complete search history.

(56) References Cited

U.S. PATENT DOCUMENTS

| | | | | |
|---|---|---|---|---|
| 2,624,328 | A * | 1/1953 | Grinham et al. | 123/193.4 |
| 5,569,841 | A * | 10/1996 | Hoban et al. | 73/47 |
| 6,164,260 | A * | 12/2000 | Bock | 123/193.2 |
| 6,367,463 | B1 * | 4/2002 | Nurmi | 123/668 |
| 7,438,038 | B2 * | 10/2008 | Azevedo et al. | 123/193.2 |
| 2003/0029397 | A1 * | 2/2003 | Hampson | 123/73 PP |
| 2007/0107689 | A1 * | 5/2007 | Oogake et al. | 123/193.2 |

* cited by examiner

*Primary Examiner*—M. McMahon
(74) *Attorney, Agent, or Firm*—Global Patent Operation

(57) ABSTRACT

A power assembly for an internal combustion engine includes a cylinder with a circular wall defining a first inside diameter. A piston is reciprocably housed within the cylinder. An integral, unitary piston deposit scraper is formed in a portion of the circular wall of the cylinder by upsetting a portion of the metallic wall so as to configure a piston scraper with a second inside diameter which is less than the first inside diameter. The inside diameter of the piston scraper closely matches that of the outside diameter of the top land of the piston. As a result, the piston scraper removes combustion deposits from the piston each time it moves into the top dead center position.

16 Claims, 2 Drawing Sheets

POWER ASSEMBLY FOR INTERNAL COMBUSTION ENGINE WITH IN-CYLINDER DEPOSIT SCRAPER

CROSS REFERENCE TO RELATED APPLICATIONS

None.

BACKGROUND OF THE INVENTION

Field of the Invention

This disclosure relates to a reciprocating internal combustion engine having an in-cylinder structure for removing deposits from the top land of the piston.

Internal combustion engines, particularly diesel or other compression-ignition internal combustion engines, are often required to operate on fuels having widely differing compositions. Unfortunately, some fuels such as marine diesel oil (MDO), or vegetable oils, or other heavy fuels, produce excessive carbon deposits which adhere to the top land of the piston. Such carbon deposits, if sufficiently thick, will rub on the bore of the cylinder and polish the cylinder bore, removing the crosshatched honing marks which are necessary for the provision of adequate piston ring lubrication. If piston rings are not lubricated properly, wear will occur, and the engine will not run properly because it will be unable to develop sufficient compression in the cylinders. Moreover, this type of deposit buildup has been observed even with diesel engines operated on lighter distillate fuels such as diesel No. 2.

It would be desirable to provide a robust, cost-effective device for scraping carbon from the top land of pistons. Such a device would be particularly useful in the context of engines having a welded cylinder heads not permitting use of an inserted deposit scraper ring.

BRIEF DESCRIPTION OF THE INVENTION

According to one aspect of the present invention, a power assembly for an internal combustion engine includes a cylinder having a circular wall defining a first inside diameter and a piston reciprocably housed within the cylinder. A connecting rod and wrist pin attach the piston to a crankshaft which is mounted within a cylinder block. A cylinder head is attached to an end of the cylinder. An integral piston deposit scraper is formed in a portion of the cylinder wall. The piston deposit scraper defines a second inside diameter which is less than the first inside diameter.

According to another aspect of the present invention, the piston deposit scraper extends downwardly into the cylinder for a distance which is proximate the height of the top land. Accordingly, the piston scraper extends substantially coextensively with the top land when the piston is at a top dead center position.

According to another aspect of the present invention, the piston scraper is formed by upsetting material from the parent metal of the cylinder, whether it be a parent bore cylinder in the cylinder block or a cylinder liner. This upsetting may be accomplished, according to an aspect of the present invention, through the use of a knurling tool.

According to another aspect of the present invention, the upsetting of metal of the cylinder bore results in a number of open top cells having walls, which act as scraper elements to remove combustion deposits from the top land of the piston as the piston reciprocates within the cylinder. The cells may be arranged as a repeating pattern having common walls which act as the scraper elements.

It is an advantage of a system, according to the present invention, that an engine may be reliably operated on heavy fuels which create large amounts of deposits, but without the problem of excessive cylinder bore wear experienced with other types of piston and cylinder combinations.

It is another advantage of a power assembly, according to the present invention, that the maintenance costs of such an engine will be reduced because of the absence of a need to disassemble the engine to remove carbon deposits from the upper part of the engine's cylinders.

It is another advantage that this system may be used with a welded cylinder head not suitable for the application of an inserted scraper ring.

It is another advantage that the present system reduces the cylinder's crevice volume, which aids in the reduction of certain regulated exhaust emissions.

Other advantages, as well as features, of the present invention will become apparent to the reader of this specification.

DETAILED DESCRIPTION OF THE PREFERRED EMBODIMENT

Figure 1:
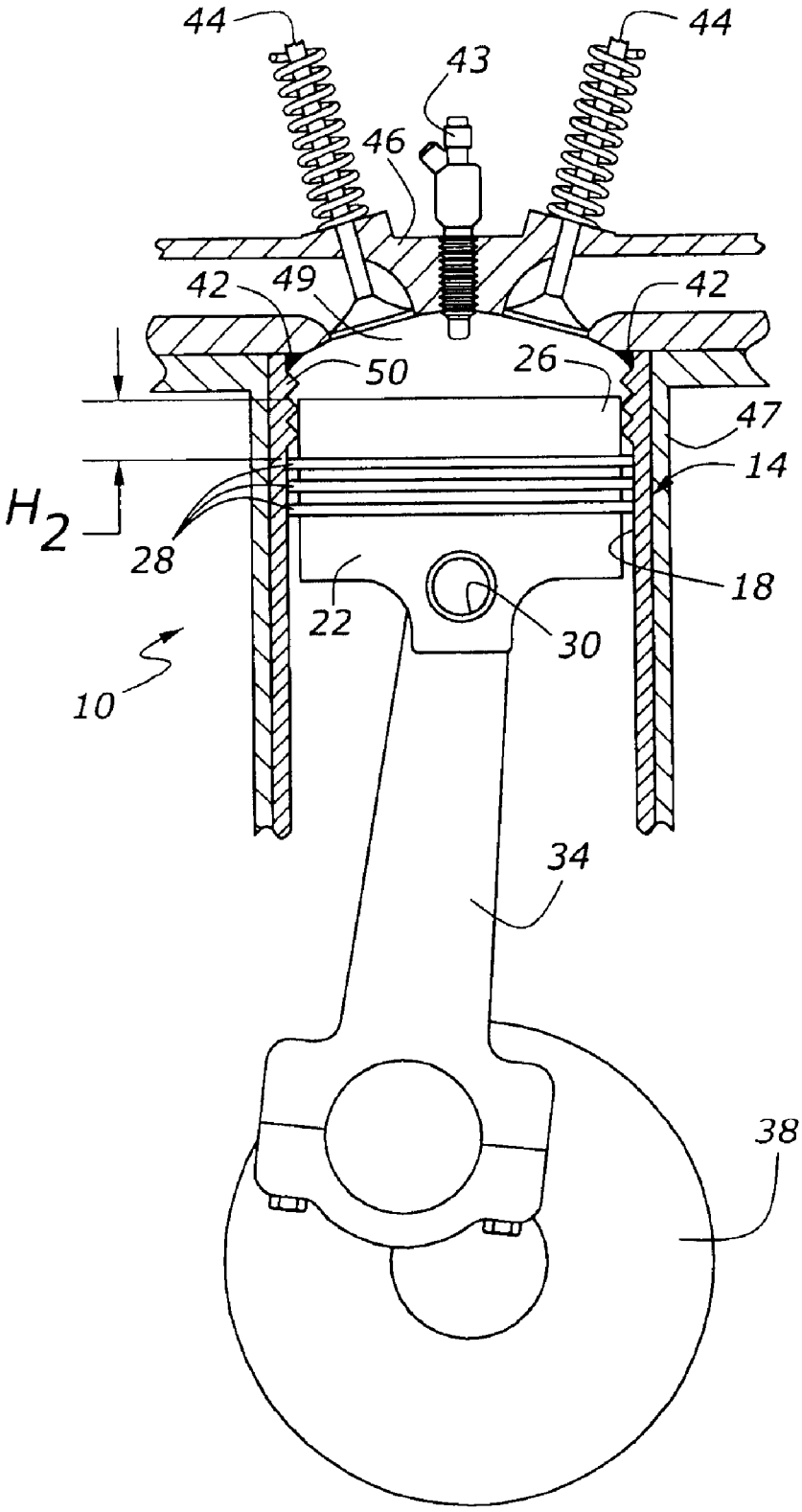
FIG. 1 is a sectional view of an engine having a piston deposit scraper according to an aspect of the present invention.

As shown in FIG. 1, engine 10 has a cylinder 14 with a circular wall 18. Piston 22 is housed reciprocably within cylinder 14. Piston 22 has a top land, 26, with a plurality of piston rings 28 being located below top land 26. Cylinder 14 is housed within cylinder block 47.

Piston 22 is attached to crankshaft 38 by means of connecting rod 34 and wrist pin 30. Conventional poppet valves 44 handle the ingress and egress of air and exhaust gasses from engine cylinder 14. Fuel injector 43 sprays into combustion chamber 49. Those skilled in the art will appreciate, in view of this disclosure, that the particular type of valving arrangements and the use of injectors, whether in-cylinder, or in-port, are matters not committed to the current invention.

FIG. 1 also shows cylinder head 46 and a piston scraper, 50, formed on a portion of circular wall 18 of cylinder 14.

Figure 2:
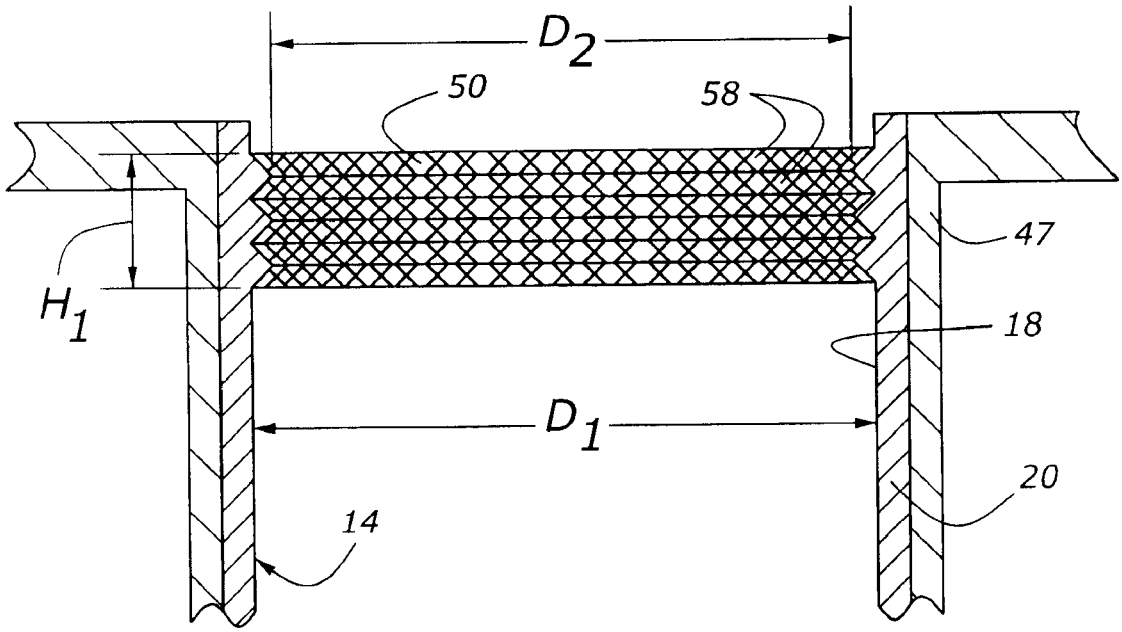
FIG. 2 shows a sectional view, partially in elevation, of an engine cylinder with a piston deposit scraper according to an aspect of the present invention.

FIG. 2 illustrates further detail of piston scraper 50, which is configured as rows of diamond patterned, four-sided, open top cells, with the walls of each cell acting as individual scraper elements. The inside diameter, D2, of piston scraper 50 is illustrated in FIG. 2. Diameter D1 is greater than the diameter D2. Diameter D2 is only slightly larger than the diameter of top land 26 of piston 22.

Figure 3:
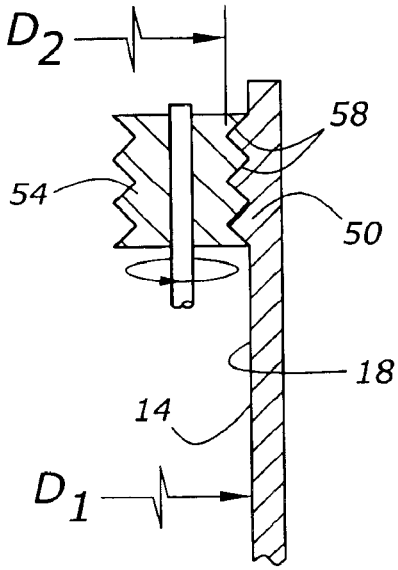
FIG. 3 is an enlarged view of a portion of a cylinder according to an aspect of the present invention, showing a knurling roller forming a unitary, integral, piston scraper according to an aspect of the present invention.

As further shown in FIG. 2, piston scraper 50 is configured with a number of walls 58, which form the previously described diamond pattern. The formation of this pattern is shown in FIG. 3, which illustrates a knurl roller, 54, which is being pressed into and rolled about the upper portion of circular wall 18. This knurling process upsets metal from the parent metal of cylinder 18 so as to cause the smaller D2 diameter as opposed to the D1 diameter. In other words, the upset metal stands proud of the base cylinder characterized by the D1 diameter. Those skilled in the art will appreciate in view of this disclosure that a number of different patterns could be used for the upsetting process, including threaded or grooved patterns. What is required is that the upset metal extend radially into the cylinder to a point at which the top land 26 of piston 22 will be engaged and scraped when piston 22 moves to its top dead center position.

Piston scraper 50 has an installed height ($H_1$, FIG. 2), which approximates the height of top land 26 of piston 22 ($H_2$, FIG. 1). In this manner, the piston scraper will scour deposits off top land 26 as piston 22 reciprocates within cylinder 14. In the embodiment of FIG. 1, however, cylinder head 46 is welded to cylinder 14 and, as a result, weld 42 occupies some of the portion of the cylinder wall which could otherwise be occupied by piston scraper 50. What is important, however, is that the lower-most portion of piston scraper 50 is generally proximate the lower-most portion of top land 26 of piston 22 when piston 22 is at top dead center. This will assure that deposits are removed from substantially the entire top land of piston 22.

In the illustrated embodiment, piston scraper 50 is installed or formed in engine 10 by first welding cylinder 14 to cylinder head 46 and then by honing cylinder 14 and, finally, by applying knurling with a knurling machine shown in part in FIG. 3. Those skilled in the art will appreciate, in view of this disclosure however, that the present system could be employed with an engine having removable cylinder liners, wherein the liners are honed and knurled as a bench operation, or honed and knurled in place in the cylinder block before the cylinder head is bolted to the cylinder block. The present system may also be employed with an engine not utilizing separate cylinder liners, but employing a removable cylinder head.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A power assembly for an internal combustion engine, comprising:

a cylinder having a circular wall of parent metal defining a first inside diameter;

a piston reciprocably housed within the cylinder;

a connecting rod and wrist pin attached to said piston;

a cylinder head attached to an end of said cylinder; and an integral piston deposit scraper formed in a portion of said circular wall, with said piston deposit scraper defining a second inside diameter which is less than said first inside diameter, wherein said piston deposit scraper is formed by working the parent metal of the cylinder to obtain a repeating pattern which stands proud of the parent surface.

2. A power assembly according to claim 1, further comprising a plurality of piston rings carried upon the outer circumference of the piston, with each of said piston rings being located below a top land of the piston.

3. A power assembly according to claim 2, wherein said piston deposit scraper extends downwardly into the cylinder for a distance which is proximate the height of said top land.

4. A power assembly according to claim 1, wherein said piston has a top land with an outside diameter which is proximate said second inside diameter.

5. A power assembly according to claim 1, wherein said piston deposit scraper is formed by knurling the circular wall of the cylinder.

6. A power assembly according to claim 5, wherein said knurling is configured as a repeating plurality of open cells having walls which extend radially from at least said first inside diameter to said second inside diameter.

7. A power assembly according to claim 5, wherein said knurling is configured as a plurality of four-sided, open-top cells, with the walls of said cells acting as individual scraper elements.

8. A power assembly according to claim 1, wherein said cylinder head is welded to said cylinder.

9. A power assembly according to claim 8, wherein said cylinder comprises a liner carried within a cylinder block.

10. A power assembly for an internal combustion engine, comprising:

a metallic cylinder having a circular wall defining a first inside diameter, with said cylinder being located within a cylinder block;

a piston reciprocably housed within the cylinder, with said piston having a plurality of piston rings arrayed below a top land defining an outside diameter;

a connecting rod and wrist pin attached to said piston;

a cylinder head attached to an end of said cylinder; and an integral, unitary piston scraper formed in a portion of said circular wall, with said piston scraper defining a second inside diameter which is both proximate the outside diameter of said top land and less than said first inside diameter, and with the piston scraper extending substantially coextensively with said top land when the piston is at a top dead center position, wherein said piston scraper is formed by upsetting material from the parent metal of said cylinder.

11. A power assembly according to claim 10, wherein the parent metal is upset by a rotary knurling tool.

12. A power assembly according to claim 10, wherein said piston scraper comprises a repeating plurality of open-topped cells having common walls which act as scraper elements to remove combustion deposits from the top land of the piston.

13. A power assembly according to claim 10, wherein said piston scraper comprises a plurality of open-topped cells having walls which act as scraper elements to remove combustion deposits from the top land of the piston as the piston reciprocates within said cylinder.

14. A reciprocating internal combustion engine, comprising:

a cylinder block;

a metallic cylinder having a circular wall defining a first inside diameter, with said cylinder being located within said cylinder block;

a crankshaft mounted within said cylinder block;

a piston reciprocably housed within the cylinder, with said piston having a plurality of piston rings arrayed below a top land defining an outside diameter;

a connecting rod and wrist pin attached to said piston and to said crankshaft;

a cylinder head attached to an end of said cylinder; and an integral piston scraper formed in a portion of said circular wall, with said piston scraper defining a second inside diameter which is proximate the outside diameter of said top land and less than said first inside diameter, and with the piston scraper extending substantially coextensively with said top land when the piston is at a top dead center position, wherein said piston scraper comprises a plurality of open-topped cells having walls which act as scraper elements to remove combustion deposits from the top land of the piston, with said cells being formed by upsetting material from the parent metal of said cylinder.

15. An internal combustion engine according to claim 14, wherein said cylinder head is welded to said metallic cylinder.

16. An internal combustion engine according to claim 14, wherein said piston scraper comprises a repeating plurality of open-topped cells having common walls which act as scraper elements to remove combustion deposits from the top land of the piston, with said cells being formed by upsetting material from the parent metal of said cylinder.

* * * * *